US008682019B2

(12) United States Patent
Akino

(10) Patent No.: US 8,682,019 B2
(45) Date of Patent: Mar. 25, 2014

(54) UNIDIRECTIONAL MICROPHONE

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 0 days.

(21) Appl. No.: 13/558,992

(22) Filed: Jul. 26, 2012

(65) Prior Publication Data

US 2013/0051600 A1 Feb. 28, 2013

(30) Foreign Application Priority Data

Aug. 24, 2011 (JP) ..... 2011-182324

(51) Int. Cl.
*H04R 9/08* (2006.01)

(52) U.S. Cl.
USPC ..... 381/355; 381/369; 381/375; 381/361; 381/322

(58) Field of Classification Search
USPC ..... 381/361, 322, 355, 369
See application file for complete search history.

(56) References Cited

U.S. PATENT DOCUMENTS

2008/0159558 A1* 7/2008 Lan et al. ..... 381/91
2010/0202649 A1* 8/2010 Inoda et al. ..... 381/361
2010/0272302 A1* 10/2010 Feiertag et al. ..... 381/361

* cited by examiner

*Primary Examiner* — Davetta W Goins
*Assistant Examiner* — Amir Etesam
(74) *Attorney, Agent, or Firm* — Manabu Kanesaka

(57) ABSTRACT

A unidirectional microphone is provided that has an excellent directional frequency response and a high sensitivity. Sound waves are guided to a rear acoustic terminal 10*b* of an acoustic resistance tube 30 through an acoustic resistance member 31. A rear end opening 30*b* of the acoustic resistance tube 30 is blocked so as to prevent the sound waves from entering the rear acoustic terminal 10*b* from the rear end opening 30*b* of the acoustic resistance tube 30 on the side of the rear acoustic terminal 10*b*. A gap G which allows low-frequency sound waves to pass and through which a front acoustic chamber A1 and a rear acoustic chamber A2 in the acoustic resistance tube 30 communicate with each other is provided between the inner peripheral surface of the acoustic resistance tube 30 and the outer peripheral surface of the microphone unit 10.

5 Claims, 7 Drawing Sheets

UNIDIRECTIONAL MICROPHONE

CROSS-REFERENCE TO RELATED APPLICATION

The present application is based on, and claims priority from, Japanese Application Serial Number JP2011-182324, filed Aug. 24, 2011, the disclosure of which is hereby incorporated by reference herein in its entirety.

TECHNICAL FIELD

The present invention relates to a unidirectional microphone, and more specifically to a technique that achieves excellent directional frequency response and improves sensitivity.

BACKGROUND ART

Unidirectional capacitor microphones are provided with a baffle arranged around a microphone unit for lengthening the inter-terminal distance between a front acoustic terminal and a rear acoustic terminal to improve sensitivity (Japanese Utility Model Application Publications Nos. H06-58696 and H06-77394).

According to this method, enlargement of the diameter of the baffle allows the sensitivity to be improved. In contrast, the enlargement causes a diffraction effect in a low frequency band, which sometimes degrades directional frequency response.

Instead, attachment of an acoustic tube, which is typically used for a narrow directional microphone, on a side of the front acoustic terminal of the microphone unit equivalently increases the distance between the acoustic terminals, thereby allowing high sensitivity to be achieved.

However, in the case where an acoustic resistance added to an opening of the tube wall of the acoustic tube is high as with that of a narrow directional microphone, the directivity is narrowed in a high frequency band. Furthermore, this configuration is equivalent to that in which a short tube is connected to the front acoustic terminal. Accordingly, the acoustic capacity according to the internal capacity of the acoustic tube and the acoustic mass of the acoustic tube cause resonance, which resultantly degrades directional frequency response.

It is therefore an object of the present invention to provide a unidirectional microphone that has an excellent directional frequency response and high sensitivity.

SUMMARY OF THE INVENTION

In order to achieves the object, the present invention provides a unidirectional microphone having an electrostatic microphone unit including a front acoustic terminal and a rear acoustic terminal, further including a cylindrical acoustic resistance tube whose front end is an opening, at least a part of or the entire tube wall being formed of a prescribed acoustic resistance member, wherein the microphone unit is accommodated in the acoustic resistance tube in a state where the front acoustic terminal is oriented toward the front end opening, sound waves are guided to the rear acoustic terminal of the microphone unit through the acoustic resistance member included in the acoustic resistance tube, a rear end opening of the acoustic resistance tube is blocked with a prescribed member so as to prevent the sound waves from entering the rear acoustic terminal through the rear end opening of the acoustic resistance tube on a side of the rear acoustic terminal, and a gap which allows low-frequency sound waves to pass and through which a front acoustic chamber and a rear acoustic chamber in the acoustic resistance tube partitioned by the microphone unit communicate with each other is provided between an inner peripheral surface of the acoustic resistance tube and an outer peripheral surface of the microphone unit.

In the present invention, an acoustic resistance member which has a low acoustic resistance and prevents the microphone unit from having a narrow directivity is adopted as the acoustic resistance member.

According to the present invention, the front end of the acoustic resistance tube of the microphone unit on the side of the front acoustic terminal is opened. Sound waves are guided to the rear acoustic terminal of the microphone unit through the acoustic resistance member included in the acoustic resistance tube. The rear end opening of the acoustic resistance tube is blocked with the prescribed member so as to prevent the sound waves from entering the rear acoustic terminal through the rear end opening of the acoustic resistance tube on the side of the rear acoustic terminal. Accordingly, the front acoustic terminal substantially elongates in the front end direction of the acoustic resistance tube. This equivalently acts as elongation of the distance between the acoustic terminals. Accordingly, the sensitivity of the unidirectional microphone is improved.

Furthermore, the gap, which allows low-frequency sound waves to pass and through which the front acoustic chamber and the rear acoustic chamber in the acoustic resistance tube communicate with each other, is provided between the inner peripheral surface of the acoustic resistance tube and the outer peripheral surface of the microphone unit. This can prevent occurrence of resonance to be caused by the acoustic capacity due to the internal capacity of the acoustic resistance tube and the acoustic mass of the acoustic resistance tube.

DETAILED DESCRIPTION

An embodiment of the present invention will now be described with reference to FIGS. 1 to 5. However, the present invention is not limited thereto.

Figure 1:
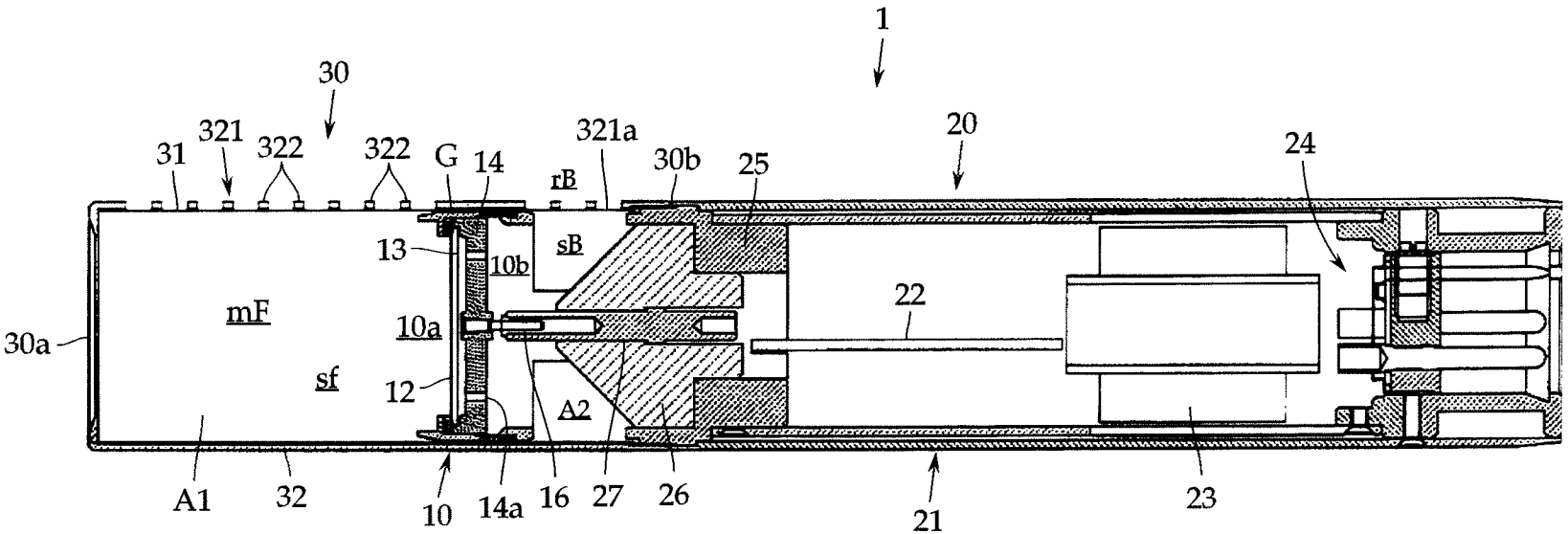
FIG. 1 is a sectional view showing an embodiment of a unidirectional microphone according to the present invention.
Figure 2:
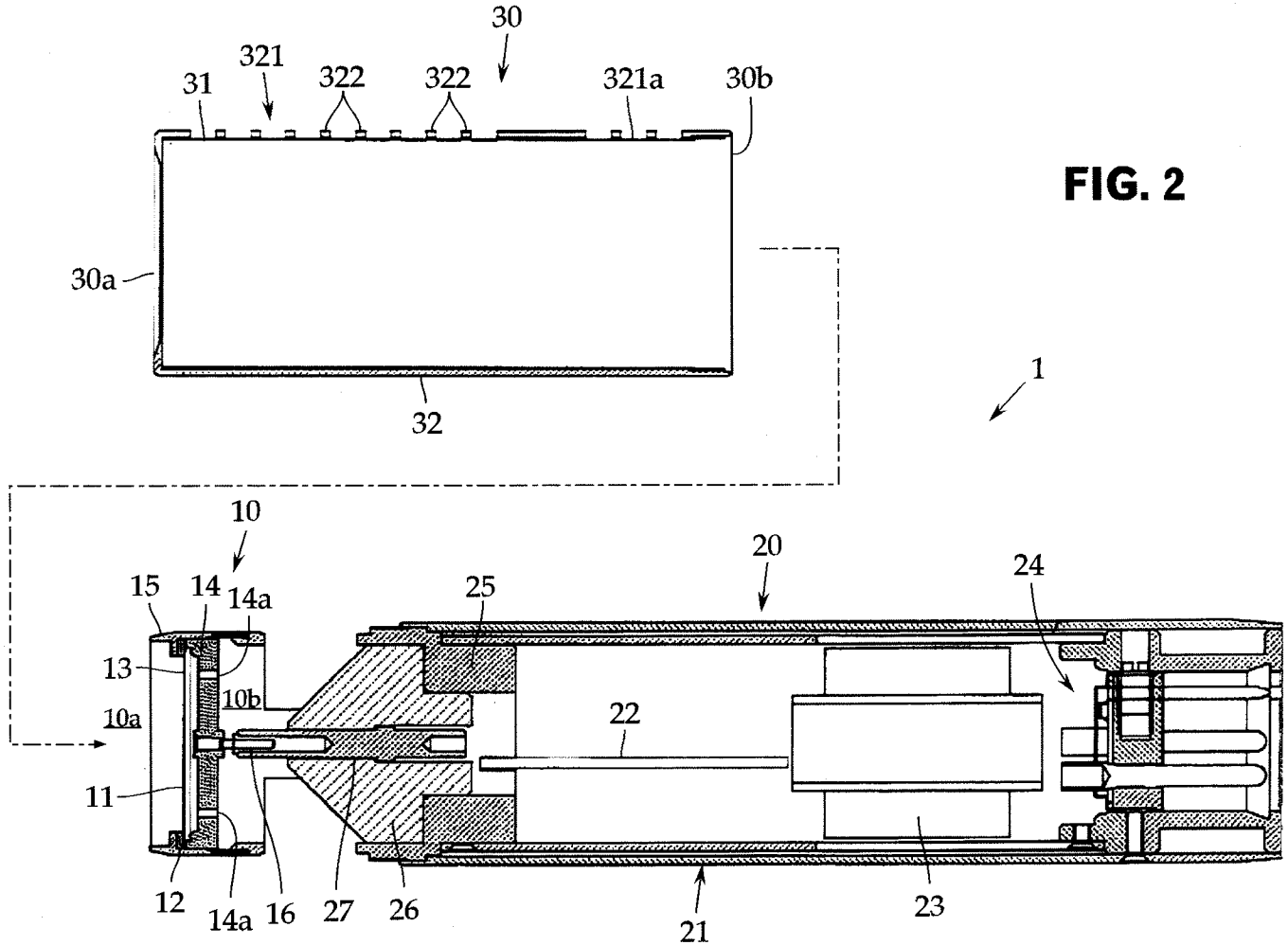
FIG. 2 is an exploded sectional view of the unidirectional microphone according to the embodiment.

Referring to FIGS. 1 and 2, a unidirectional microphone 1 according to this embodiment includes a microphone unit 10, an audio signal output unit 20, and acoustic resistance tube 30 for covering the microphone unit 10.

The microphone unit 10 is a unidirectional capacitor microphone unit that includes a front acoustic terminal 10*a* and a rear acoustic terminal 10*b*. The microphone unit 10 includes a diaphragm 11, and a fixed electrode 13 as an opposite electrode thereof. The diaphragm 11 is disposed in a unit casing 15 that has a cylindrical shape and is made of a metal, in a state of being stretched over a support ring (diaphragm ring) 12.

The fixed electrode 13 is disposed on the rear side of the diaphragm 11 in the unit casing 15 with intervention of a spacer ring, not shown, in a state of being supported by an insulating holder 14 made of a plastic or the like. An electrode pin 16 is implanted into a substantially central part of the insulating holder 14. The electrode pin 16 is electrically connected to the fixed electrode 13.

In the unidirectional microphone unit 10, a front side of the diaphragm 11 is a front acoustic terminal 10*a*, and a rear side of the insulating holder 14 is the rear acoustic terminal 10*b*. A sound hole 14*a* is formed through the insulating holder 14. Although not shown, an analogous sound hole is formed through the fixed electrode 13. Sound waves from the rear acoustic terminal 10*b* act on the rear side of the diaphragm 11 through these sound holes.

The audio signal output unit 20 is also referred to as an output module or a power module. In this embodiment, a cylindrical grip casing 21 made of a metal accommodates a circuit board 22, an output transformer 23, an output connector 24 and the like. Although not shown, the circuit board 22 is mounted with a FET (field-effect transistor) as an impedance converter, an amplifying circuit, a low cut circuit and the like.

An insulating cap 26 is disposed at the front end of the grip casing 21 with intervention of a spacer 25 made of a metal. A female connector terminal 27, which is to be mated with the electrode pin 16 on the side of the microphone unit 10, is provided in the insulating cap 26.

This configuration allows the fixed electrode 13 to be connected to the gate electrode of the FET via the electrode pin 16, the female connector terminal 27 and a wiring member, not shown. A tripolar (three-pin) output connector to be connected to a phantom power source, not shown, is adopted as the output connector 24.

The acoustic resistance tube 30 includes a configurational element that is an acoustic resistance member 31 having a low acoustic resistance preventing the unidirectional microphone 1 from having a narrow directivity.

Nonwoven fabric JH-1007 (made of polyester fiber to have a surface density of 70 g/m$^2$ and a thickness of 0.13 mm) manufactured by Japan Vilene, for instance, is preferably adopted as this type of the acoustic resistance member 31. In some cases, a porous plate, which is a thin metal plate or the like having many fine pores and has low acoustic resistance as with the nonwoven fabric, may be adopted.

The acoustic resistance tube 30 may be configured only by the acoustic resistance member 31. However, in the case of being made of a nonwoven fabric, the strength is insufficient to hold the cylindrical shape. Accordingly, it is preferred that a support cylinder 32 made of a metal or a plastic for the structure be adopted and the support cylinder 32 hold the acoustic resistance member 31.

In this embodiment, as shown in FIGS. 1 and 2, for instance, a slit-shaped side opening 321 is formed at a part of the tube wall of the support cylinder 32 along the axial direction. The acoustic resistance member 31 made of a nonwoven fabric is adhered to the inner surface of the support cylinder 32 so as to cover the side opening 321.

Only one side opening 321 is shown in FIGS. 1 and 2. However, the side opening 321 may be provided at each of positions at prescribed intervals along the circumferential direction of the support cylinder 32, such as positions separated by 180°, 120° or 90°. In this embodiment, the side opening 321 is formed into a grille shape. Reference numeral 322 denotes crosspieces arranged across the side opening 322 along the circumferential direction.

For instance, what is called a punching plate on which many circular openings are formed over the entire surface, or a plate having side openings over the entire surface such as a grating plate may be adopted as the support cylinder 32. In these cases, the acoustic resistance member 31 made of a nonwoven fabric is adhered to the entire inner surface of the support cylinder 32.

Provided that an opening at the front end of the acoustic resistance tube 30 is denoted by reference symbol 30*a* and an opening at the rear end is denoted by reference symbol 30*b*, the acoustic resistance tube 30 is covered on the microphone unit 10 as shown in FIG. 1 such that the rear end opening 30*b* is blocked with the spacer 25 and the insulating cap 26, which are provided at the front end of the audio signal output unit 20.

Accordingly, a front acoustic chamber A1 having a prescribed capacity is provided at a front side of the front acoustic terminal 10*a* of the microphone unit 10, and a rear acoustic chamber A2 is provided at a side of the rear acoustic terminal 10*b*. In the present invention, the opening 30*a* on the front end side of the acoustic resistance tube 30 opposite to the front acoustic terminal 10*a* is formed into an opening whose entire area is opened, and the rear end opening 30*b* of the acoustic resistance tube 30 is blocked as described above to prevent sound waves from entering the rear acoustic terminal 10*b* through the rear end opening 30*b*.

Thus, the rear end opening 30*b* of the acoustic resistance tube 30 is blocked such that sound waves do not enter the rear acoustic terminal 10*b* through the rear end opening 30*b*. However, on the acoustic resistance tube 30, the side opening 321 is formed along the substantially entire length of the support cylinder 32, and a part 321*a* at the rear end of the side opening 321 is arranged so as to cover the rear acoustic chamber A2. Accordingly, sound waves are guided into the rear acoustic terminal 10*b* through the acoustic resistance member 31 existing at the part 321*a* at the rear end.

Thus, the front end opening 30*a* on the side of the front acoustic terminal 10*a* of the acoustic resistance tube 30 is opened, and the rear end opening 30*b* on the side of the rear acoustic terminal 10*b* is blocked. Accordingly, the front acoustic terminal substantially elongates in the front end direction of the acoustic resistance tube. This equivalently acts as elongation of the distance between the acoustic terminals. Accordingly, the sensitivity of the unidirectional microphone 1 is improved.

Furthermore, in the present invention, a gap G which allows low-frequency sound waves to pass and through which the front acoustic chamber A1 and the rear acoustic chamber A2 communicate with each other is provided between the inner peripheral surface of the acoustic resistance tube 30 and the outer peripheral surface of the microphone unit 10. The clearance of the gap G may be about 0.2 to 0.3 mm, depending on the diameter of the microphone unit 10 to be used.

Since such a gap G is thus provided, resonance to be caused by the acoustic capacity due to the internal capacity of the acoustic resistance tube 30 and the acoustic mass of the acoustic resistance tube 30 can be prevented from occurring. This allows the directional frequency response to become excellent.

Figure 3:
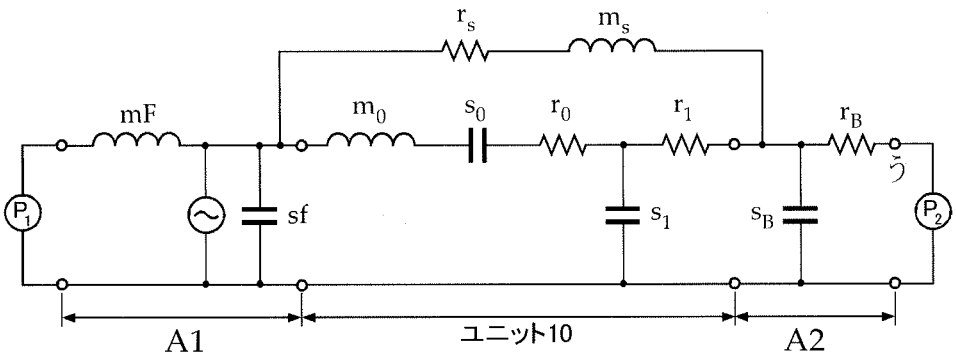
FIG. 3 is an equivalent circuit diagram of the unidirectional microphone according to the embodiment.

FIG. 3 shows an equivalent circuit of the unidirectional microphone 1 according to this embodiment.

Reference symbol $P_1$ denotes a front sound source. Reference symbol $P_2$ denotes a rear sound source. Reference symbols mF and sf denote the acoustic mass and the air stiffness of the front acoustic chamber A1, respectively. Reference symbols $m_0$, $s_0$ and $r_0$ denote the mass, the stiffness and the damping resistance of the diaphragm 11, respectively. Reference symbols $r_1$ and $s_1$ denote the acoustic resistance and the air stiffness, respectively, which provide the rear acoustic terminal 10*b* with directivity. Reference symbols $r_B$ and $s_B$ denote the acoustic resistance of the sound waves intake (321*a*) of the rear acoustic chamber A2 and the air stiffness of the rear acoustic chamber A2, respectively. Reference symbols $r_s$ and $m_s$ denote the acoustic resistance and the air stiffness existing in the gap G, respectively. An alternating-current signal source shown in the front acoustic chamber A1 represents sound waves to be captured via the acoustic resistance member 31.

Figure 4A:
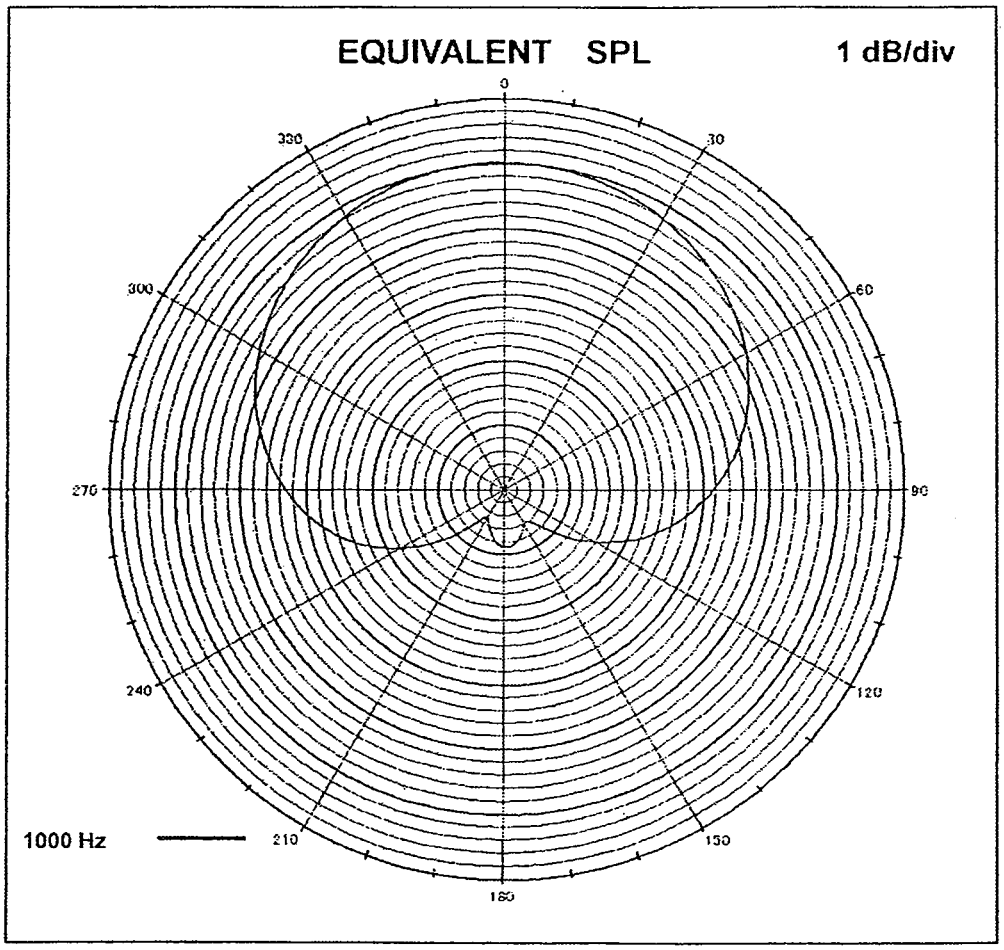
FIG. 4A is a diagram of a polar pattern measured in a state where a microphone unit is covered with an acoustic resistance tube.
Figure 4B:
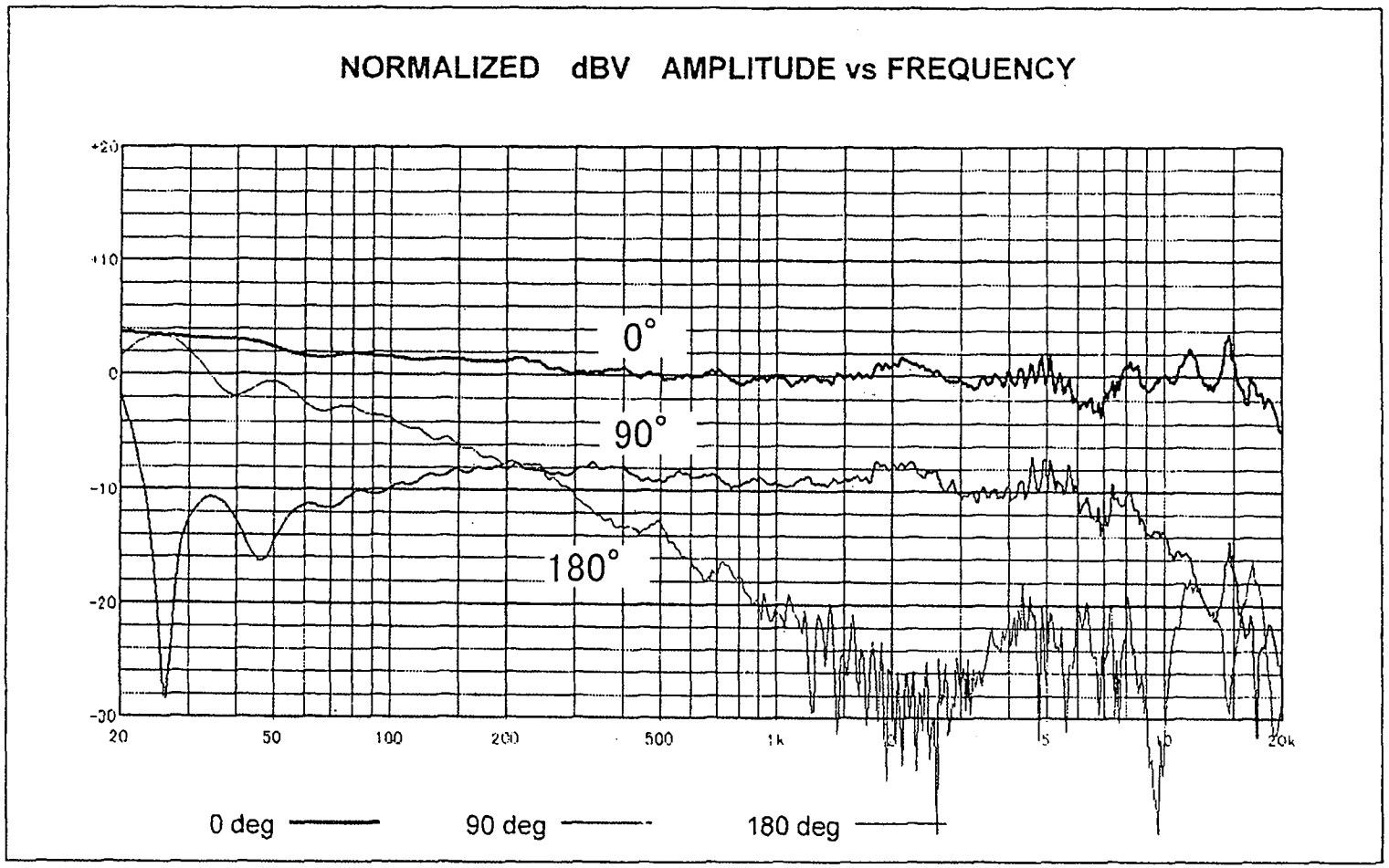
FIG. 4B is a graph showing directional frequency response of FIG. 4A.
Figure 5A:
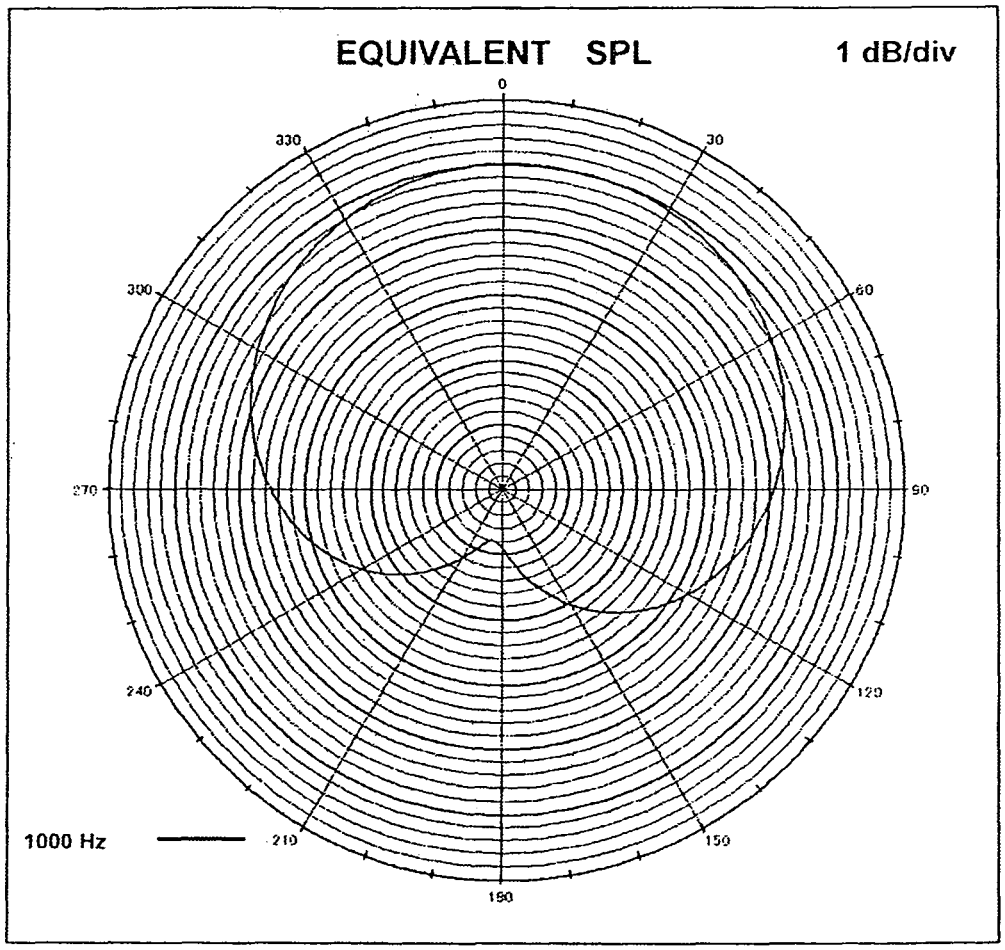
FIG. 5A (RELATED ART)
FIG. 5A is a diagram of a polar pattern measured only by the single microphone unit as a comparative example.
Figure 5B:
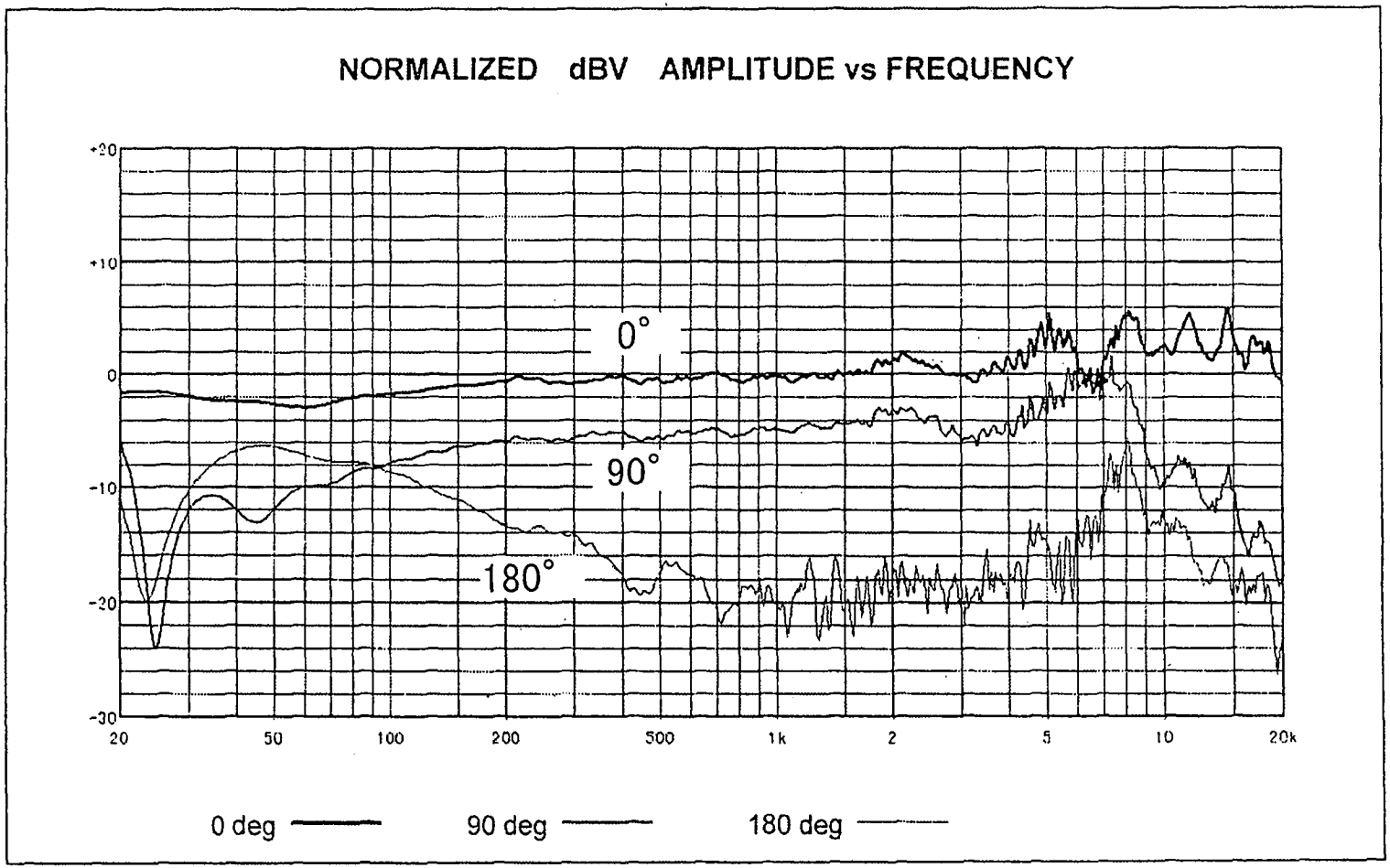
FIG. 5B (RELATED ART)
FIG. 5B is a graph showing directional frequency response of FIG. 5A.

FIGS. 4A and 4B show graphs of a polar pattern and directional frequency response that are measured by the unidirectional microphone 1 covered with the acoustic resistance tube 30 according to this embodiment. FIGS. 5A and 5B show graphs of a polar pattern and directional frequency response that are measured by the unidirectional microphone where the acoustic resistance tube 30 is removed, as a comparative example. The acoustic resistance tube 30 used for the measurement has an axial length of about 40 mm and an inner diameter of about 26 mm. The nonwoven fabric JH-1007 manufactured by Japan Vilene is adopted as the acoustic resistance member 31.

FIGS. 5A and 5B show that, in the case of the comparative example without the acoustic resistance tube 30, the response is that of a typical unidirectional microphone.

In contrast, the distance between the acoustic terminals elongates by covering the acoustic resistance tube 30. Accordingly, as shown in the directional frequency response in FIG. 4B, the sensitivity is improved by about 2 dB in comparison with the comparative example, and the frequency response is also improved particularly in low frequencies. As shown in the polar pattern in FIG. 4A, the directivity tends a little to be hypercardioid.

The invention claimed is:

1. A unidirectional microphone comprising:

an electrostatic microphone unit including a front acoustic terminal, a rear acoustic terminal and an electrode pin arranged at a side of the rear acoustic terminal, a cylindrical acoustic resistance tube housing the microphone unit and including a front end portion having a front opening, a rear end portion having a rear opening, a tube wall extending between the front end portion and the rear end portion, an acoustic resistance member attached to an inner surface of the tube wall, a front acoustic chamber and a rear acoustic chamber separated through the microphone unit in the acoustic resistance tube such that the front acoustic chamber is provided at a side of the front acoustic terminal and the rear acoustic chamber is provided at the side of the rear acoustic terminal, and a gap communicating the front acoustic chamber and the rear acoustic chamber and formed between an inner peripheral surface of the acoustic resistance tube and an outer peripheral surface of the microphone unit to pass low-frequency sound waves therethrough, a spacer attached to the rear opening of the acoustic resistance tube, an insulating cap mounted on the spacer, the spacer and the insulating cap blocking the rear opening of the acoustic resistance tube to prevent sound waves from entering the rear acoustic terminal through the rear opening and to guide the sound waves to the rear acoustic terminal of the microphone unit through the acoustic resistance member of the acoustic resistance tube, and a connector terminal arranged in the insulating cap and connecting the electrode pin in the rear acoustic chamber, wherein the front acoustic terminal is oriented toward the front end opening.

2. The unidirectional microphone according to claim 1, wherein the acoustic resistance member has a low acoustic resistance and prevents the microphone unit from having a narrow directivity.

3. The unidirectional microphone according to claim 1, wherein the microphone unit further comprises a unit casing for housing the front acoustic terminal and the rear acoustic terminal, and an insulating holder arranged between the front acoustic terminal and the rear acoustic terminal in the unit case;

the front acoustic terminal includes a diaphragm and a fixed electrode disposed on a rear side of the diaphragm, and the diaphragm and the fixed electrode are arranged at a front side of the insulating holder; and the electrode pin at the side of the rear acoustic terminal projects from the insulating holder toward the connector terminal and is electrically connected to the fixed electrode through the insulating holder.

4. The unidirectional microphone according to claim 3, wherein the fixed electrode includes a sound hole formed therethrough and the insulating holder includes a sound hole formed therethrough such that the sound waves from the rear acoustic terminal act on the diaphragm through the sound holes.

5. The unidirectional microphone according to claim 1, wherein the tube wall includes slit-shaped side openings formed on a portion corresponding to the rear acoustic chamber to guide the sound waves to the rear acoustic terminal of the microphone unit through the acoustic resistance member.

* * * * *